United States Patent [19]

Rabelos

[11] 4,184,567

[45] Jan. 22, 1980

[54] FIRE ESCAPE DEVICE WITH ROPE LOOP CLAMP

[75] Inventor: Nicholas A. Rabelos, 7 Armour La., Riverdale, Ga. 30274

[73] Assignees: Thomas G. Clark; Kenneth B. Clary; J. Melvin England; Charles O'Brien, Jr.; Nicholas A. Rabelos, all of Atlanta, Ga.

[21] Appl. No.: 938,786

[22] Filed: Sep. 1, 1978

[51] Int. Cl.[2] ..... A62B 1/14

[52] U.S. Cl. ..... 182/5; 188/65.4; 188/65.5

[58] Field of Search ..... 182/5, 6, 7; 188/65.4, 188/65.5

[56] References Cited

U.S. PATENT DOCUMENTS

| | | | |
|---|---|---|---|
| 200,387 | 2/1878 | Garoutte | 182/5 |
| 362,173 | 5/1887 | Nudd | 182/5 |
| 3,235,031 | 2/1966 | Cenker | 182/5 |
| 3,532,189 | 10/1970 | Wade | 182/5 |

*Primary Examiner*—Reinaldo P. Machado
*Attorney, Agent, or Firm*—Clarence A. O'Brien; Harvey B. Jacobson

[57] ABSTRACT

A fire escape device having an elongated flexible element terminating in an end anchorable to a building structure and having a length sufficient to reach a lower, safe support level. Detachably mounted on the flexible element for longitudinal movement therealong is a slide and sling assembly including a clamp arranged for clampingly engaging the flexible element in such a manner as to form a loop therein. By this arrangement, the rate of descent of a person using the device can be controlled not only by tightening and untightening the clamp itself, but also by pressure applied to the loose end of the flexible element by the user or by any other person below.

8 Claims, 4 Drawing Figures

FIRE ESCAPE DEVICE WITH ROPE LOOP CLAMP

BACKGROUND OF THE INVENTION

1. Field of the Invention

The present invention relates generally to fire escape devices, and particularly to a device which enables persons trapped in the interior of a building or other enclosure to safely descend from the building to a safe level some distance below a level at which a person or persons may be trapped.

2. Description of the Prior Art

Many fatal injuries have resulted from persons being trapped in the interior of a building by a fire located between the location of the persons and a normally provided escape route from the building. This is particularly a problem in modern highrise structures, which usually are provided with only interior stairwells and elevator systems. Accordingly, numerous proposals have been made for enabling such trapped individuals to escape by lowering themselves down the exterior wall of a building from a window opening, and the like.

My prior U.S. Pat. Nos: 3,507,763, issued Apr. 7, 1970; 3,765,507, issued Oct. 16, 1973; 3,834,489, issued Sept. 10, 1974; and 4,056,166, issued Nov. 1, 1977, and references cited therein, are representative of such fire escape devices. In many of the previous devices, the slide structure is assembled on the flexible rope or other element, since the flexible element is threaded through the slide member, thus necessitating that the person using the fire escape device put the sling on while positioned adjacent the flexible element. Thus, even though more than one slide member could be positioned on the flexible element, under near panic conditions which may exist, it sometimes occurs that a number of individuals adjacent the flexible member interfere with each other when trying to gain access to a sling since all of the slings would be located in an adjacent relation.

The disadvantages of many prior art devices were overcome by my U.S. Pat. No. 4,056,166. Nevertheless, the slide disclosed in this patent is of rather complex construction including several pieces which had to be properly connected to one another for attachment to the rope. In addition, this prior device failed to permit a person using the device to control the rate of descent of the person by employing pressure to the free end of the rope or other flexible element in addition to controlling the pressure applied to the flexible element by a clamp provided on a slide member of the device.

SUMMARY OF THE INVENTION

It is an object of the present invention to provide a fire escape device including an elongated flexible element and a slide and sling assembly movably mounted on the element, wherein the slide is of simplier, yet more reliable and efficient, construction than prior devices of this kind.

It is another object of the present invention to provide a fire escape including an elongated flexible element and a slide and sling assembly movably mounted on the element, wherein the rate of descent by a person using the device can be controlled by grasping the free, or loose, end of the flexible element, in addition to adjusting a clamp which frictionally engages the flexible element.

These and other objects are achieved according to the present invention by providing a fire escape device having: an elongated flexible element having an end anchorable to a building structure and being of a length sufficient to reach a lower, safe support level beneath a level of the building structure to which the flexible element is anchored; and a slide and sling assembly detachably mounted on the flexible element for longitudinal movement therealong, the slide and sling assembly including a clamp arranged for clampingly engaging the flexible element and forming a loop in the element intermediate the ends thereof.

The slide and sling assembly preferably further includes a plate partially formed the clamp and provided with a substantially planar surface. The clamp further includes a pad provided with a substantially planar face arranged opposite the planar surface of the plate, with a manually operable screw-threaded fastener arranged interconnecting the plate and pad for permitting movement of the plate and pad toward and away from one another with the surface and face of the plate and pad, respectively, remaining substantially parallel to one another during such movement. The flexible element is slidably arrangeable between the plate and pad, and is looped around the screw-threaded fastener for being selectively clamped between the plate and pad by adjustment of the screw-threaded fastener.

The clamp advantageously further includes a hole provided in the plate in spaced relation to the screw-threaded fastener, with two lengths of the extent of the threaded element being slidably disposed in the hole. The plate is further provided with an opening spaced from the hole, and from the screw-threaded fastener, with the latter being disposed directly between the hole and the opening. The slide and sling assembly further includes a sling slidably disposed in the opening provided in the plate.

The screw-threaded fastener preferably includes a screw-threaded stud, or bolt, extending substantially perpendicularly from the planar surface of the plate, with a bore being provided in the pad for receiving the stud. A screw-threaded nut is disposed threadingly engaging the stud for permitting the pad to be tightened and loosened against the flexible element which is looped around the stud.

The slide and sling assembly advantageously further includes a pin disposed extending substantially perpendicularly from the planar surface of the plate, and substantially parallel to but spaced from the stud, with the pad being provided with an aperture spaced from the bore equidistance to the spacing of the pin from the stud so that the pin will be slidably disposed in the aperture so as to prevent rotation of the pad relative to the plate.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
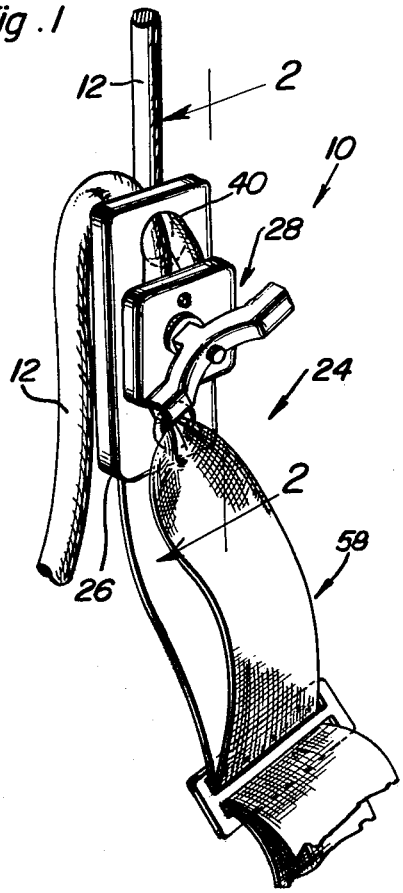
FIG. 1 is a fragmentary, schematic, perspective view showing a fire escape device according to the present invention.
Figure 2:
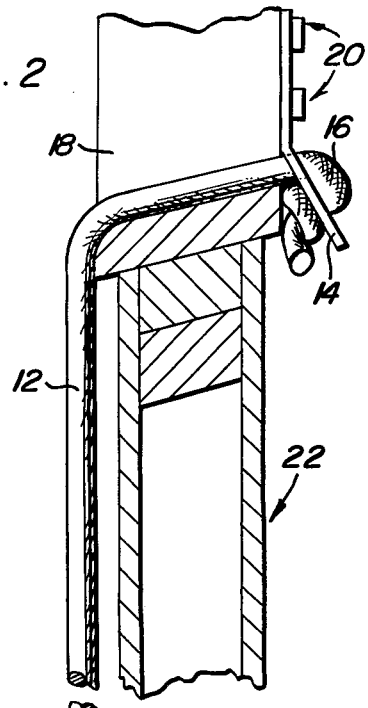
FIG. 2 is an enlarged, fragmentary, schematic, sectional view taken generally on the line 2—2 of FIG. 1.

A fire escape device 10, according to the present invention, includes an elongated flexible element 12, which can be in the form of a flexible rope of natural or synthetic fiber material formed in a conventional manner, which element 12 has a pair of longitudinally spaced ends, one of which ends is illustrated as inserted through a pair of aligned openings in a mounting bracket 14 and retained on bracket 14 as by the illustrated knot 16 formed in the one of the ends of element 12. Bracket 14 is shown as supported along the inner surface of a window opening 18 as by bolts 20, and the like, with the element 12 extending exteriorly of a building structure 22 through window opening 18. Bracket 14 can be located adjacent the window sill or at any position interiorly of the room enclosure, or element 12 may be connected to any other stationary object within building structure 22. Element 12 can even be anchored to the leg of a large furniture item, bedstead, and the like, none of which are shown, which article of furniture will not exit through window opening 18. The specific manner of connecting element 12 to building structure 22 may be varied and adapted to the particular installational requirements with element 12 being selected so as to be sufficiently strong to support several individuals as they descend down the element 12, and any manner of connecting element 12 to a stationary object within structure 22 may be employed provided such connection is sufficient to support such weight of several individuals. The length of element 12 is selected so as to be adequate to extend to the ground level or other safe lower levels from various floor levels in homes, apartment buildings, office buildings, motels, school buildings, and any other similar buildings which are occupied by people above a ground floor. With fire escape device 10 properly installed, one or more persons which may be trapped in the building enclosure can safely escape by descending along the element 12.

Escape along element 12 is effected by one or more slide and sling assemblies 24 which can be individually fastened in a simple manner to element 12 by each of several persons using element 12 for escape from a burning building, and the like. Each slide and sling assembly 24 comprises a slide 26 including a clamp 28 arranged for clampingly engaging flexible element 12 and forming a loop in element 12 intermediate the ends thereof. The formation of this loop within the extent of element 12 permits greater control of the descent of a user of an assembly 24 than could be obtained by adjustment of clamp 28 alone.

Slide and sling assembly 24 further includes a plate 30 partially forming clamp 28 and provided with a substantially planar surface 32. Clamp 28 also includes a pad 34 provided with a substantially planar face 36 arrangeable opposite and substantially parallel to the surface 32 of plate 30. A manually operable screw-threaded fastener 38 interconnects plate 30 and pad 34 for moving plate 30 and pad 34 toward and away from one another, with surface 32 and face 36 of plate 30 and pad 34, respectively, remaining substantially parallel to one another during such movement. Flexible element 12 is slidably arranged between plate 30 and pad 34, and is looped around fastener 38, for being selectively clamped between surface 32 and face 36 by adjustment of fastener 38 in order to vary the frictional pressure restraining clamp 28 from movement relative to element 12.

Figure 3:
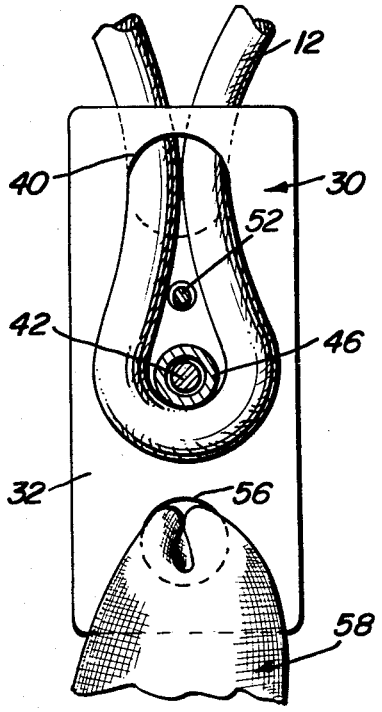
FIG. 3 is a fragmentary, sectional view taken generally along the line 3—3 of FIG. 2.
Figure 3:
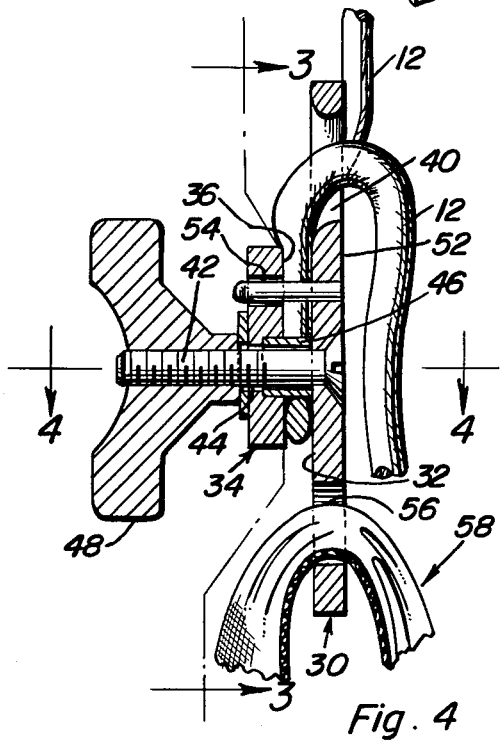
Figure 4:
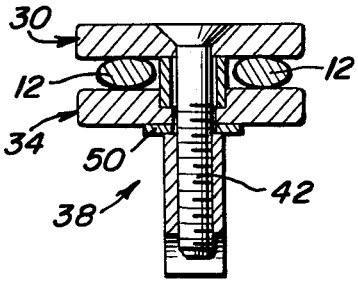
FIG. 4 is a sectional view, somewhat schematic, taken generally along the line 4—4 of FIG. 2.

Clamp 28 further includes a hole 40 provided in plate 30 in spaced relation to fastener 38, with two intermediate lengths of the flexible element 12 being slidably disposed in hole 40 so as to cause element 12 to loop substantially completely around itself and depart clamp 28 at a point immediately adjacent the entry of element 12 into clamp 28. Fastener 38 includes a screw-threaded stud 42, which can be in the form of a conventional machine bolt, and the like, passed through plate 30 from the rear surface thereof as illustrated, which stud 42 extends substantially perpendicularly from surface 32 of plate 30. A bore 44 is provided in pad 34, with stud 42 being slidably disposed in bore 44. A bushing 46 of generally cylindrical configuration is seated in a recess provided in face 36 of pad 34 so as to abut against surface 32 of plate 30 and create a support for flexible element 12 as well as a minimum spacing between the surface 32 and face 36. A screw-threaded wing nut 48, and the like, is disposed threadingly engaging the screw threads of stud 42, with a washer 50 being disposed between nut 48 and the outside face of pad 34. Flexible element 12 is, as can best be seen from FIG. 3, looped around bushing 46, and also stud 42 since the latter passes through the center of bushing 46, and out through hole 40 from which it entered in order to form the aforementioned loop within the extent of element 12.

Slide and sling assembly 24 further includes a pin 52 fit into a socket provided in plate 30 such that pin 52 extends substantially perpendicularly from the planar surface 32 of plate 30 and substantially parallel to, but spaced from, stud 42. Pad 34 is provided with an aperture 54 which is spaced from bore 44 of pad 34 a distance equal to the spacing of pin 52 from stud 42, such that pin 52 will be slidably disposed in aperture 54 in order to prevent rotation of pad 34 relative to plate 30.

Plate 30 is further provided with an opening 56 spaced from hole 40 and from stud 42 of fastener 38 with stud 42 being disposed directly between hole 40 and opening 56. A sling 58 of conventional construction is slidably disposed in opening 56 for engagement in the conventional manner by a person (not shown) using device 10.

As can be readily understood from the above description and from the drawing, a fire escape device according to the present invention permits one to slide down a rope or other flexible element in a safe manner. A slide and sling assembly according to the invention can be readily mounted on the rope or other flexible element intermediate the ends thereof by undoing nut 48, removing pad 34, and looping the rope around the stud of the screw-threaded fastener. Subsequently, pad 34 and nut 48 can be removed and clamped down against the rope to give a predetermined tension on the slide. Not only can a person using the device control the rate of descent down the rope or flexible element by adjusting the pressure exerted on the flexible element by the clamp, but can achieve an even greater control by exerting pressure on the free end of the flexible element, which further control is made possible by the looping of the flexible element in the manner described.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An elongated flexible element having an end anchorable to a building structure, and having a length which is selected to be sufficient to reach a lower, safe support level beneath a point of anchoring to the building structure, slide and sling assembly means detachably mounted on the flexible element for longitudinal movement therealong, the slide and sling assembly means including a clamp means arranged for clampingly engaging the flexible element and forming a loop in the element, and further including a plate partially forming the clamp means and provided with a substantially planar surface, the clamp means also including a pad provided with a substantially planar face arranged substantially parallel to and opposite of the planar surface of the plate, and a manually operable screw-threaded means interconnecting the plate and pad for moving the plate and pad toward and away from one another, with the surface and face of the plate and pad, respectively, remaining substantially parallel to one another during such movement, the flexible element being slidably arranged between the plate and pad and looped around the screw-threaded means for being selectively clamped between the plate and pad by the screw-threaded means.

2. A structure as defined in claim 1, wherein the clamp means includes a hole provided in the plate in spaced relation to the screw-threaded means, with two lengths of the flexible element being slidably disposed in juxtaposition within the hole.

3. A structure as defined in claim 2, wherein the plate is further provided with an opening spaced from the hole, and the screw-threaded means, the latter being disposed directly between the hole and the opening, with the slide and sling assembly means further including a sling slidably disposed in the opening.

4. A structure as defined in claim 2, wherein the screw-threaded means includes a screw-threaded stud extending substantially perpendicularly from the planar surface of the plate, a bore being provided in the pad, with the stud being slidably disposed in the bore of the pad, and a screw-threaded nut being disposed threadingly engaging the stud, the pad being disposed between the nut and the plate and the flexible element being disposed between the plate and the pad and looped around the stud.

5. A structure as defined in claim 4, wherein the slide and sling assembly means further includes a pin disposed extending substantially perpendicularly from the planar surface of the plate and substantially parallel to, but spaced from, the stud, the pad being provided with an aperture spaced from the bore a distance equal to the spacing of the pin from the stud, the pin being slidably disposed in the aperture for preventing rotation of the pad relative to the plate.

6. A structure as defined in claim 5, wherein the plate is further provided with an opening spaced from the hole and from the stud, the latter being disposed directly between the hole and the opening, with the slide and sling assembly means further including a sling slidably disposed in the opening provided in the plate.

7. In a portable fire escape device comprising an elongated flexible element having an end capable of being anchored with respect to a building structure and also having a length sufficient to reach a lower, safe support level relative to a point of attachment on the building structure, and a slide and sling assembly including clamp means adjustably engaging the flexible element for controlling the rate of descent of the slide along the flexible element, the improvement wherein the clamp means forms a loop in the flexible element, the slide and sling assembly further including a plate partially forming the clamp means and provided with a substantially planar surface, the clamp means further including a pad provided with a substantially planar face arranged substantially parallel to and opposite of the surface provided on the plate, and a manually operable screw-threaded means interconnecting the plate and pad for moving the plate and pad toward and away from one another, with the surface and face of the plate and pad, respectively, remaining substantially parallel to one another during such movement, the flexible element being slidably arranged between the plate and pad and looped around the screw-threaded means for being selectively clamped between the plate and pad by the screw-threaded means, with the clamp means further including a hole provided in the plate and spaced relative to the screw-threaded means, with two lengths of the extent of the flexible element being slidably disposed in juxtaposition within the hole provided in the plate.

8. An improvement as defined in claim 7, wherein the screw-threaded means includes a screw-threaded stud extending substantially perpendicularly from the planar surface of the plate, and a bore provided in the pad, the stud being slidably disposed in the bore, and a screw-threaded nut being disposed threadingly engaging the stud and abutting the pad, the flexible element being looped around the stud, with a pin extending substantially perpendicular from the planar surface of the plate and substantially parallel to, but spaced from, the stud, the pad being provided with an aperture spaced from the bore a distance equal to the spacing of the pin from the stud, with the pin being slidably disposed in the aperture for preventing rotation of the pad relative to the plate, the plate being further provided with an opening spaced from the hole and from the stud, the latter being disposed directly between the hope and opening, with a sling of the slide and sling assembly being slidably disposed in the opening provided in the plate.

* * * * *